US005665462A

United States Patent [19]

Dewar

[11] Patent Number: 5,665,462

[45] Date of Patent: Sep. 9, 1997

[54] CLOSURE

[75] Inventor: George Galloway Dewar, Cremorne, Australia

[73] Assignee: Dewco Investments Pty Ltd, Dee Why, Australia

[21] Appl. No.: 406,149

[22] Filed: Mar. 20, 1995

[30] Foreign Application Priority Data

Mar. 18, 1994 [AU] Australia ..... PM4582
Aug. 29, 1994 [AU] Australia ..... PM7741

[51] Int. Cl.[6] ..... B32B 5/02; B32B 29/00

[52] U.S. Cl. ..... 428/220

[58] Field of Search ..... 428/234, 235, 428/245, 280

[56] References Cited

U.S. PATENT DOCUMENTS

| | | | |
|---|---|---|---|
| 926,895 | 7/1909 | Quillot | 215/364 |
| 3,772,136 | 11/1973 | Workman | 161/169 |
| 3,874,541 | 4/1975 | Lagneaux et al. | 215/253 |
| 4,091,136 | 5/1978 | O'Brien et al. | 428/141 |
| 4,182,458 | 1/1980 | Meckler | 215/307 |
| 4,349,122 | 9/1982 | Klar et al. | 220/373 |
| 5,052,578 | 10/1991 | Goodwin | 220/352 |

*Primary Examiner*—Helen Lee

*Attorney, Agent, or Firm*—Lowe, Price, LeBlanc & Becker

[57] ABSTRACT

A closure for a container having an opening, comprising a resilient mass of interlocked and/or otherwise associated synthetic and/or natural fibres having a density of 0.18 to 2.00 g/cm$^3$, wherein the closure is of suitable shape and density to enable the closure to be sealingly inserted into the opening of said container.

29 Claims, 2 Drawing Sheets

CLOSURE

This invention relates to closures for containers, particularly wine bottles, and to methods for making same.

Wine bottle closures made from natural cork can be the source of chemicals which may produce mouldy taints in the contents of the bottle. These chemicals (such as trichloroanisoles) may originate from the bleaching process used for cork which involves treatment with chlorine or other chloro compounds. Wine which has been exposed to such chemicals is described as being "corked", and it has been estimated that up to 10% of all bottles of wine sold worldwide may be corked in this manner.

Further, cork is becoming an increasingly scarce commodity and is now so expensive that some winemakers have resorted to the use of corks made from agglomerated particles of recycled cork. These so-called "agglo" corks have also been shown to taint wine, probably, in part, as a result of the glue used.

Consequently, there is a great need for inexpensive alternatives to cork bottle closures. Two such alternatives are plastic "champagne-style" corks and metal screw-cap "Stelvin" closures. Whilst these types of closures produce an excellent seal, their use has been limited to low grade wines due to their poor aesthetic qualities.

It is new proposed that closures comprising synthetic and/or natural fibres, particularly wool, would be an excellent alternative to cork.

Accordingly, the present invention provides a closure for a container having an opening, comprising at least one resilient mass of interlocked and/or otherwise associated synthetic and/or natural fibres having a density of 0.15 to 2.00 g/cm$^3$, wherein the closure is of suitable shape and density to enable the closure to be sealingly inserted into the opening of said container.

By term "fibres" we refer to materials that may be formed into a yarn, textile, carpet or the like.

Interlocking of fibres may be achieved, for example by "felting" processes, needle-punching, weaving and/or knitting. By the use of the term "otherwise associated" we refer to other means for preparing a resilient mass of fibres. For example, the fibres, or a portion of the fibres, may be bonded together with an adhesive or polymers having adhesive-like qualities.

The fibres, or a portion of the fibres, may also be present in the form of bonded "relied yarns" or "felted slivers".

Preferred natural fibres include vegetable fibres such as cotton, flax, sisal, linen, cellulose and jute, and animal-derived fibres such as angora, wool, alpaca and mixtures thereof.

Preferred synthetic fibres include cellulose acetate, cellulose triacetate, acrylics, aramids (i.e. aromatic polyamides), rayons, polyolefins (e.g. polypropylene), nylons, polyesters, polyurethanes, terylenes, teflon and mixtures thereof.

Mixtures of the abovementioned synthetic and/or natural fibres may also be suitable. Most preferably, the fibres are sheep wool or fibre mixtures including sheep wool fibres.

Preferably, the resilient mass of fibres has a density of 0.18 to 0.95 g/cm$^3$, more preferably 0.4 to 0.8 g/cm$^3$.

Closures according to the invention may further comprise one or more additives which may be added, for example, to vary the resilience or density of the fibre mass; to vary the sealing properties of the closure; and/or assist insertion or extraction of the closure. The additives may also be added in order to isolate the fibre mass from the contents of the container.

Accordingly, the fibres comprising the resilient mass and/or the outside of the closure may be coated, wholly or partially (e.g. the ends of the closure only), with a coating material such that the contents of the container do not directly contact the fibres. Alternatively, the coating materials could be used to fill part or all of the interfibre spaces (i.e. impregnants) in the closure. Where the contents of the container is a food or beverage, the coating and/or impregnant material would preferably be selected from those which are "food-contact approved". As a further safety measure in food and beverage applications, the mass of fibres would also, preferably, be sterilised.

Suitable coatings include those typically used in packaging materials such as polyethylene dispersions, modified polyethylene dispersions and gels of polymers such as ethylene vinyl acetate copolymer (EVA), solutions and dispersions of poly(vinylidene chloride) and its copolymers (e.g. foamed and non-foam PVC), polyurethanes, acrylic latexes, lacquers and dispersions and various thermoformed films. Paraffins, waxes and silicones may also be suitable additives.

The closures may also have more than one coating, each coating being the same or different in composition. It is also to be understood that an impregnant may be used in conjunction with one or more coatings. Including multiple coatings (particularly of wax), may assist in the production of closures having a more uniformly smooth surface (which may enhance the sealing qualities of the closure). Harder coatings such as some PVDC's and hard acrylics may also be machined using a polishing brush or the like to provide a smooth surface.

The additive(s) may comprise 0.01–70% (by weight) of the closure, more preferably 0.1–30% (by weight). Where the additive(s) impregnate the fibres of the fibre mass, it is preferred that they comprise 1–30% weight) of the fibre mass.

To incorporate or apply additives to the fibre mass, it may be necessary to dry (e.g. by microwave or hot air tumbling) or pre-treat the fibre mass to improve adhesion or incorporation. Where the fibre mass is a wool fibre mass, the pre-treatment(s) may be selected from chlorine treatment, UV treatment and other oxidising treatments.

The additives may be applied or incorporated into the fibre mass by dipping, spraying and/or injecting. Alternatively, individual fibres or bundles of fibres may be coated and then formed into a resilient mass of interlocked and/or otherwise associated fibres.

Preferably, any additives should not greatly affect the resilience of the fibre mass. Thus, the preferred additives are PVC's and polyurethanes, particularly when applied as coatings to the outside of the fibre mass, as these additives are particularly good at preserving the resilience of the fibres in the fibre mass. The PVC's also show low friction qualities which can assist in the insertion and extraction of the closure from the opening of a container. These low friction qualities may also be varied by adjusting the amount and/or kind of plasticisers used or extenders (in the case of polyurethane).

Closures according to the invention may also be provided with end caps of additives, that is caps of about 2.0 to 5.0 mm thick on one or both ends of the closure. These caps may provide structural integrity and avoid any distortion of the closure upon insertion into an opening.

The closures according to the invention may also include more than one mass of fibres. In such embodiments the fibre masses may be bonded together with an adhesive and may have the same or different characteristics. That is, they may, for example, have different densities, different additives or be produced in different manners. One fibre mass may be impermeable to liquids, whilst another may be impermeable to gaseous molecules. Fibre masses may also be bonded to and separated from each other by one or more liquid and/or gas-impermeable membranes. The membranes may also extend to a slightly larger diameter than the fibre mass in order to assist in forming for entirely form) the seal between the closure and the surface of the container's opening, with the fibre mass providing the necessary compression force.

In addition, due to the resilience of the fibre mass(es), the closures according to the invention may not necessarily resemble a shape which mirrors the opening to be sealed. For instance, a closure for a wine bottle may, preferably, have the shape and dimensions similar to standard cork closures with or without curved ends (concave or convex) but may also be spheroid or ovoid. The closure may also comprise a fibre mass having the standard shape of a cork closure but provided with O-rings formed of rubber or other resilient polymer. The O-rings would thus assist in forming (or entirely form) the seal between the closure and the bottle neck, with the fibre mass providing the necessary compression force. Some of the envisaged shapes and constructions of closures for wine bottles are depicted at FIG. 1.

In order to meet the sealing require menus for the broadest range of containers/contents, and particularly for application in the wine and spirit industry, it is preferred that the closure is substantially impermeable to liquids and gases.

Closures according to the invention may be formed in several manners. One method is by conventional felting of the fibres in sheet form, followed by "punching-out" or cutting out of wads of fibres for use as, or in, closures.

Conventional felting and various treatments and pretreatments for felt are reviewed in Wool Science Review 61 (International Wool Secretariat—Development Centre, Valley Drive, Ilkley, Yorks), the disclosure of which is incorporated herein by reference.

Thus, in a further aspect, the invention provides a method for producing a closure having suitable shape and density to enable the closure to be sealingly inserted into an opening of a container, comprising punching-out or cutting out a form from a resilient sheet of interlocked and/or otherwise associated synthetic and/or natural fibres.

The "form" may be suitable for use as a closure, or additives may be added to produce a closure.

Preferably, the resilient sheet of fibres is a sheet of felted fibres, particularly felted wool fibres. The "forms" may be punched out or cut out of sheets of wool felt either through the top or bottom of the sheet or through the ends or sides of the sheet. Punching or cutting the forms from the ends of the sheet should provide forms wherein the fibres predominantly lie in a direction substantially parallel to the longitudinal direction of the form. This orientation of most of the fibres may positively affect the resilient qualities of the form.

Additives as described above, may be added during the production of the felt sheet or following the punching-out or cutting out of the form.

Alternatively, closures according to the invention or suitable forms of interlocked and/or otherwise associated synthetic and/or natural fibres, may be produced by extrusion, for example through a die by means of a single-screw or twin-screw extruder.

Thus, in a still further aspect, the invention provides a method for producing a closure having suitable shape and density to enable the closure to be sealingly inserted into an opening of a container, comprising extruding through a die a resilient mass of interlocked and/or otherwise associated synthetic and/or natural fibres which may be subsequently cut into a form.

Again, the "form" may be suitable for use as a closure, or additives may be added to produce a closure.

In such a method, additives may be added during the production of the resilient mass of fibres or following cutting of the resilient mass of fibres. It is also envisaged that the mass of fibres may be extruded into a length having a "daisy flower" or "honeycomb" cross-section which may subsequently be extruded in the presence of additives (which may be presented in the form of a gas or solution) through a second circular die of smaller cross-section. In this manner, additives will be incorporated into the mass at the spaces between the fibres.

Closures according to the invention may also be formed by bending particulate felt sheet in a suitably shaped mould.

Closures according to the invention may be readily adapted to be suitable for sealing openings in many different kinds of container. However, the closures are primarily intended for use in the wine and spirits industry, and particularly for sealing wine barrels and wine bottles. The closures are hereinafter described in respect to their use in sealing wine bottles.

It is believed that wool closures would have considerable appeal to winemakers and drinkers alike for several reasons. That is:

Wool is relatively inexpensive and widely available;

Wool is a natural product with a pleasant appearance;

When interlocked (e.g. felted) or otherwise associated, it has been found that wool fibres retain sufficient resilience to prevent compression set of the closure upon insertion into the neck of a bottle. This enables the closure to provide a satisfactory seal;

Wool closures according to the invention may be inserted into the neck of a bottle using standard corking machines. They may also be extracted using an ordinary cork screw.

When wool fibres are used, it is preferable that they are from scoured, unspun wool. Wool fibres that have been subjected to further cleaning processes (e.g., carding and combing) are likely to require lesser volumes of any desired additives, however the use of such fibres may result in the lose of some of the rustic appeal of the closure clean wool may be readily dyed with food-approved colourants to restore the rustic appeal of the closure. Food-approved colourants may also be used to give the closures a colour resembling that of cork closures.

The invention shall now be further described with reference to the following non-limiting examples and accompanying drawings.

EXAMPLE 1

Preparation of Closures

MATERIALS AND METHODS

Preparation of Wads (fibre masses)

Figure 1:
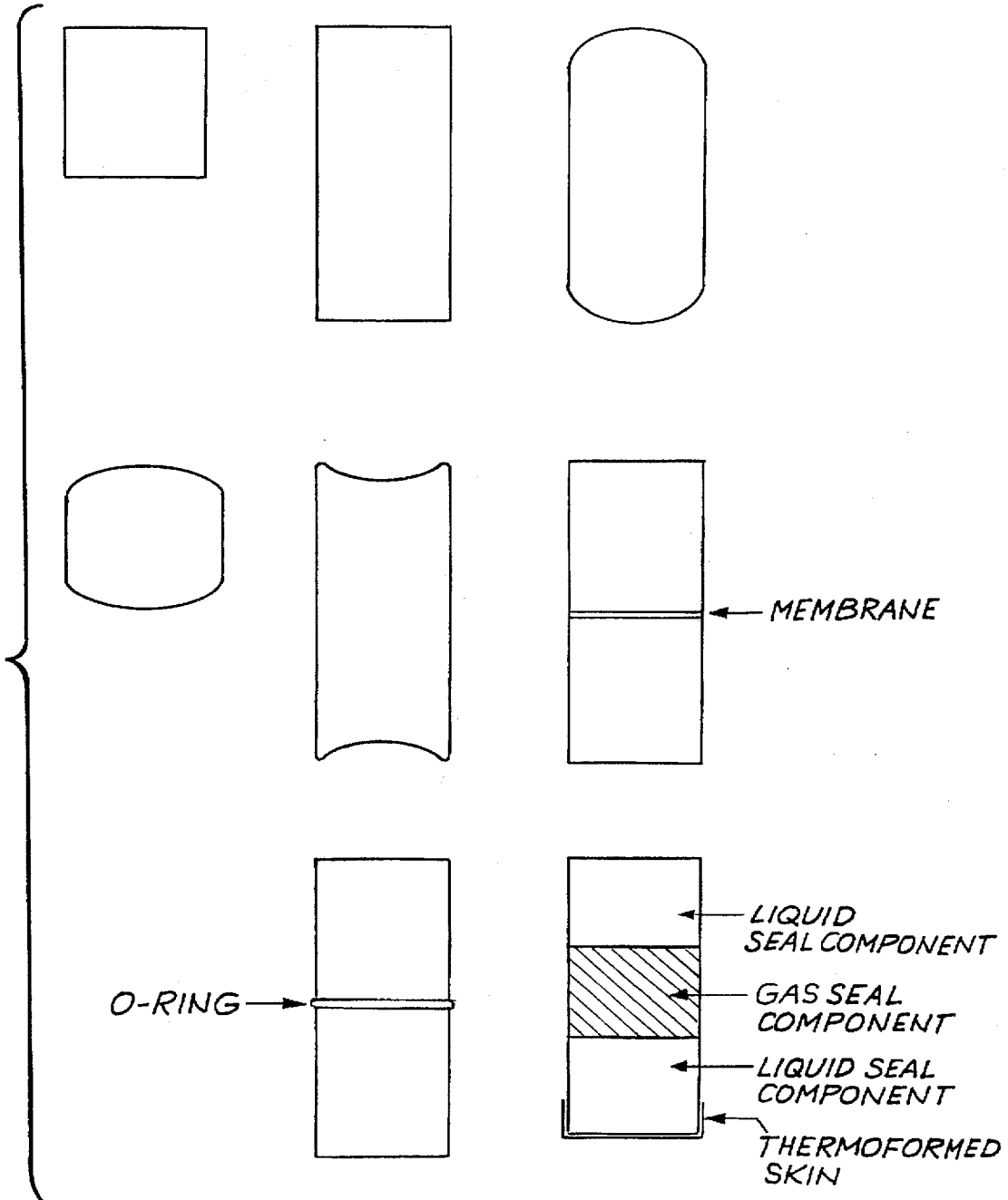
FIG. 1 diagrammatically shows the longitudinal cross-sectional shape and construction of closures according to the invention intended for sealing wane bottles.

Cylindrical wad forms were cut from wool felt sheet of density 0.35 g/cm$^3$ (manufactured by P&F Filtration Ltd, Australia), and 0.45 g/cm$^3$ (manufactured by Bury Cooper and Whitehead Ltd, U.K.). Cutting was performed by forcing a steel punch of chosen internal diameter in a mechanical press through the felt. The press required the construction of a collar to house the punch. This ensured a parallel cut through the sheet. The speed of cutting was slow enough to allow the wad to remain uncompressed. Excessive speed cutting speed tended to cause concaved sides on the wad. The wads had diameters of 17 mm, 18 mm, 22 mm, 25 mm or 28 mm and were 27 or 28 mm thick when cut out of the felt. When creasing of certain coated wads of 28 mm diameter was observed to prevent an adequate seal to the bottle neck, the wads of smaller diameter were used.

Impregnation of Wads

The wads were weighed and placed in the appropriate impregnating liquid either in a beaker held in a desiccator, or in a Quickfit standard taper (Female, B24) ground glass fitting. The wad in the beaker was impregnated by exhaustion of air from the desiccator using the vacuum generated by a water tap aspirator. The wad sank into the impregnating medium when the air was removed. The desiccator was removed from the vacuum source, opened and the wad removed and weighed before drying. When the impregnating liquid was sucked through the wad the vacuum source was removed and the wad was weighed before and after drying. In some cases, the wad was inverted and the impregnating liquid passed through again. Wads from both treatments were typically dried in a microwave oven at 202 watts for 4 minutes.

Coatings (1) Wax and silicone coatings.

wax or silicone coatings were applied by dipping the wads into the coating agent with the aid of tweezers. Wax coating weights were controlled by control of the temperature of the wax with lower coating weights being obtained at higher temperatures.

(2) PVC Plastisol Coatings.

Two PVC plastisols were used initially. The first, W. R. Grace AD07-2126.3 does not foam when heated to 180° C. for 5 minutes. The second, Daraseal 700 (Sicpa), foams under these conditions. The coating was achieved by first pouring plastisol, (5 g for 28 mm was length, 7 g for 48 mm wad length) into a cylindrical aluminium mould, 48 mm deep with an internal diameter of 20 mm. A wed of 18 mm (non-foaming plastisol) or 17 mm (foaming plastisol) diameter was then lowered carefully into the mould to within 4 mm of the bottom. The wad was held by means of a screw hook inserted into the top of the wad and the wad was slowly turned to assist in the distribution of the plastisol. The mould and its contents was then heated in a fast-recovery oven at (180° C. for non-foaming and 200° C. for foaming) for 5 minutes, followed by cooling before removal of the coated wad. The base of the mould was unscrewed and the wad removed. When the non-foaming PVC was used the coated wad had a PVC layer approximately 1 mm thick around the diameter and 2 mm thick at the bottom when the foamable plastisol was used the foam layer was approximately 1.5 mm thick at the sides and 3–4 mm thick at the bottom.

The non-foaming plastisol is essentially transparent and light pink in colour so that the felt can be seen inside the coating. The foam layer is white and opaque.

(3) Latex Coatings.

A curtain rod hook was inserted into the end of the wad, which was then dipped into latex (from various suppliers: Morton, Michelman, B.A.S.F., Dragon Chemicals and Dussek Campbell) leaving the top uncoated. The wad was removed and placed immediately into a fast recovery oven at 105° C. for five minutes, then re-immersed in the latex and placed in a fast recovery oven at 95° C. for five minutes.

(4) Thermoformed Skin Coatings.

Wads of 22 mm diameter and thickness of 28 mm were covered with a commercial laminating adhesive (Lamal, Coates Bros, Sydney) and tightly packed to approximately half their thickness by thermoforming a skin of Surlyn (Du Pont plastics) ionomer film around them on a commercial blister packing machine. The film did not form a crease-free skin beyond half the thickness of the film. A wad was tested for its effectiveness in preventing liquid loss from a bottle of wine simulant after insertion into the bottle with the skin-covered end towards the wine simulant. The use of tubular forms of thermoformed skin should avoid creasing problems. The ends of a closure enclosed in a tubular thermoformed skin may be dipped in sealing plastic.

Two-part closures with a membrane in between

Wads were cut in halves to give two wads of thickness approximately 14 mm each. These were combined to give a single wad by means of a circular piece of double-sided adhesive tape based on a film of polypropylene. This type of wad was found to break easily due to inadequate cohesion. Wads impregnated with an acrylic emulsion were used and found to have adequate cohesion to allow insertion into the bottles but the seal against the glass at the top joint was not found to be satisfactory for wine applications.

Three-part closures

Three wads of 22 mm diameter were taken and two were skin packed with Surlyn in one case and Primacor (ethylene acrylic acid copolymer) in the other. These two wads were then cut in halves by means of a Stanley Knife and the unsealed end was discarded in each case. Half of the third wad was impregnated with Michelman Prime 4990R emulsion of ethylene acrylic acid copolymer to give some additional adhesion to the bottle neck. The latter half-wad was placed between the other two wads with the double-sided tape as adhesive. The wad inserted into the wine simulant using a hand corking machine and the Surlyn-skinned end wad towards the outside of the bottle.

EXAMPLE 2–36

Wool Felt-Latex Closures

All closure examples 1–35 were made using wads of 0.35 g/cm$^3$ wool felt. The felt wads used in the closures of Examples 2–22 were 28 mm in diameter, and 27 mm in length. The felt wads used in the closures of Examples 23–28 were also 27 mm in length but varied in diameter as indicated in Table 1.

TABLE 1

| Example No | Latex Name | Type | FDA Compliance | Felt diameter (mm) | Solution Solid % | % Coating | Dry Closure Pull Out Force (kg) 1 day | 2 days | Film Properties |
|---|---|---|---|---|---|---|---|---|---|
| 2 | Glascol C36 | acrylic | unconfirmed | 28 | 2.5 | 11 | 59 | 32 | hard, brittle |
| 3 | Glascol C36 | acrylic | unconfirmed | 28 | 5 | 15 | 40 others push through | 43 38 | hard, brittle |
| 4 | Glascol C36 | acrylic | unconfirmed | 28 | 10 | 29 | 55 35 | 61 86 | hard, brittle |
| 5 | Q-thane | urethane | unconfirmed | 28 | 2.5 | 15 | 26 25 23 | 36 32 | hard, flexible, after 4 days water immersion at room temperature softening and heavy whitening observed |
| 6 | Michelman X300 | acrylic | 176,170 176,180 | 28 | 2.5 | 13 | 21 17 | 29 20 | soft, waxy |
| 7 | Michelman X300 | acrylic | 176,170 176,180 | 28 | 5 | 14 | 23 38 | 31 32 | soft, waxy |
| 8 | Michelman X300 | acrylic | 176,170 176,180 | 28 | 10 | 31 | 33 29 30 | 26 38 35 | soft, waxy |
| 9 | Michelman X300 | acrylic | 176,170 176,180 | 28 | 15 | 32 | 30 37 29 | — | soft, waxy |
| 10 | Michelman 50A | acrylic | 176,176 | 28 | 2.5 | 16 | 37 37 41 | 27 33 31 | Medium hardness, ductile cohesion. After 4 days water immersion at room temperature slight softening and heavy whitening observed |
| 11 | Michelman 68725 | Polyethylene | not approved | 28 | 5 | 17 | 16 15 15 | 15 22 20 | soft, waxy |
| 12 | Michelman 48040 | microwax | not approved | 28 | 5 | 15 | 13 13 | 14 17 14 | medium hardness, waxy |
| 13 | BASF 193D | polyvinylidene chloride | unconfirmed | 26 | 5 | 18 | 28 30 23 | 32 23 22 | hard, brittle |
| 14 | Michelman 01546 | microwax | unconfirmed | 28 | 5 | 11 | 10 18 | 14 13 10 | very soft, waxy |
| 15 | Michelman 763 | acrylic | 176,180 175,350 175,320? | 28 | 5 | 14 | 34 35 30 | 33 37 45 | Medium hardness, firm cohesion. After 4 days water immersion at room temperature slight softening and whitening observed |
| 16 | BASF 360D | acrylic | unconfirmed | 28 | 5 | 14 | 40 57 58 | 46 41 56 55 | Soft and ductile. After 4 days water immersion at room temperature softening and whitening observed |
| 17 | Michelman 240 | polymeric acrylic | unconfirmed | 28 | 5 | 14 | 13 | 15 15 12 | Medium hardness, waxy |
| 18 | Michelman 124 | microwax | unconfirmed | 28 | 5 | 15 | 10 14 | 14 | soft, waxy |
| 19 | Michelman 93135 | high density polyethylene | not aproved | 28 | 5 | 15 | 19 17 18 | 21 22 16 | medium hardness, flaky |
| 20 | Michelman 40-H H.S. | polymeric acid | 176,170 176,180 | 28 | 2.5 | 11 | 17 17 14 | | soft, low film strength. After 4 days water immersion at room temperature slight softening and heavy whitening observed |
| 21 | Michelman P20 | precoat 20 | unconfirmed | 28 | 2.5 | 9 | 18 26 | 19 16 | Soft medium coherence. After 4 days water immersion at room temperature softening and heavy whitening observed |
| 22 | Michelman 103D1 | polyethylene (anionic emulsifier) | 176,170 | 28 | 5 | 14 | 14 | — | soft, waxy |
| 23 | Michelman 103D1 | polyethylene (anionic emulsifier) | 176,170. | 25.4 | 5 | 14 | 8 6 | — | soft, waxy |
| 24 | Michelman 103D1 | polyethylene (anionic | 176,170 | 22.2 | 5 | 14 | pushed in | | soft, waxy |

TABLE 1-continued

| Example No | Latex Name | Type | FDA Compliance | Felt diameter (mm) | Solution Solid % | % Coating | Dry Closure Pull Out Force (kg) 1 day | 2 days | Film Properties |
|---|---|---|---|---|---|---|---|---|---|
| | | emulsifier) | | | | | | | |
| 25 | Michelman 42745 | wax (nonionic emulsifier) | 175,105<br>175,300<br>175,320<br>176,170<br>176,180 | 28 | 5 | 11 | 16<br>21<br>20 | — | firm, waxy |
| 26 | Michelman 42745 | wax (nonionic emulsifier) | 175,105<br>175,300<br>175,320<br>176,170<br>176,180 | 25.4 | 5 | 11 | 11<br>9<br>6 | — | firm, waxy |
| 27 | Michelman 42745 | wax (nonionic emulsifier) | 175,105<br>175,300<br>175,320<br>176,170<br>176,180 | 22.2 | 5 | 11 | pushed in | | firm, waxy |
| 28 | Michelman Prime 4990R | ethylene acrylic acid | 177,3100c<br>176,170b<br>176,180<br>175,105<br>175,300b<br>175,320b | 22.2 | 5 | 18 | 7<br>10<br>10 | — | hard, strong |
| 29 | Michelman Prime 4990R | ethylene acrylic acid | 177,3100c<br>176,170b<br>176,180<br>175,105<br>175,300b<br>175,320b | 25.4 | 5 | 16 | 35<br>33<br>25<br>24<br>16<br>25 | — | Hard firm. After 4 days water immersion at room temperature slight softening observed |
| 30 | Serfene 121 | polyvinylidene chloride | unconfirmed | | | | | | Hard, brittle. After 4 days water immersion at room temperature slight whitening observed |
| 31 | Michelman 368 | wax | unconfirmed | | | | | | medium hardness, waxy |
| 32 | Michelman 160 | carnuaba wax | approved | | | | | | medium hardness, waxy |
| 33 | Michelman 162 | carnuaba wax | approved | | | | | | medium hardness, waxy |
| 34 | BASF S504 | acrylic | unconfirmed | | | | | | medium-soft, ductile cohesion. After 4 days water immersion at room temperature softening and whitening observed |
| 35 | Michelman 40A | acrylic | unconfirmed | | | | | | medium hardness, ductile cohesion |
| 36 | BASF BASOPLAST 400DS | acrylic (low wet-out) | unconfirmed | | | | | | hard, brittle |

*average value based on weight changes and accounting for 10% moisture loss on drying Table 1 provides the characteristics for closure Examples 2–36 and results for extraction tests on these examples. Data from duplicate examples are provided in some instances. By way of comparison, standard cork closures typically required an extraction-force of 35–40 kg.

The extraction results where the bottle was not filled with liquid provides an indication of the compression forces with time and the interaction of the closure with glass.

The film properties were determined by drying the latex on a petri dish and evaluating dried film by a simple finger nail scratch test.

EXAMPLE 37–44

Effect of Closure Diameter (uncompressed) on Closure Length in Bottle

The effects of varying the diameter of the closure on the length of the closure when inserted into the neck of the bottle was investigated.

Table 2 provides the results for wool felt-based closures under compression in the bottle neck. All wads used in the closures had an initial fibre density of 0.35 g/cm$^3$ and a length of 28 mm.

TABLE 2

| | Example | Original diam. (mm) | Pre-Compression Length (mm) | Post-Compression Length (mm) |
|---|---|---|---|---|
| 37 | Untreated wad | 28 | 28–29 | 34 |
| 38 | Untreated wad | 25.4 | 27–28 | 30 |
| 39 | Untreated wad | 22 | 27 | 30 |
| 40 | Untreated wad 0.45 nominal density 30 mm original length | 21 | 31 | 33 |
| 41 | Impregnated with 5% Micryl 763 | 22 | 29–30 | 30 |
| 42 | Impregnated with 5% Micryl 763 | 25.4 | 39–30 | 34 |
| 43 | Impregnated with 5% Micryl 763 | 28 | Too hard to insert into bottle | |
| 44 | Impregnated with 5% Michelman 4990R | 25.4 | 30 | 31 |

EXAMPLE 45

Oxygen Permeability Tests performed on various closure

Figure 2A:
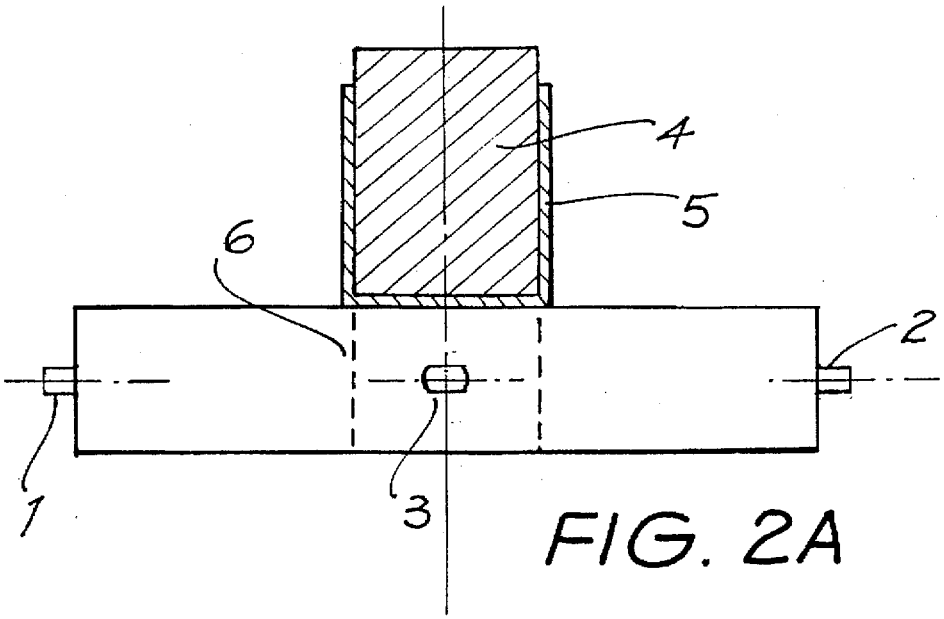
FIG. 2A provides a diagrammatic elevation representation of the test cells used for testing oxygen permeability. The test cell was made from brass, the various ports being ⅛" Swagelock fittings. (1) and (2) are gas flushing ports, (3) is the sampling port, (5) is a tube into which a sample closure (4) is placed, and (6) is a perforated support tube.
Figure 2B:
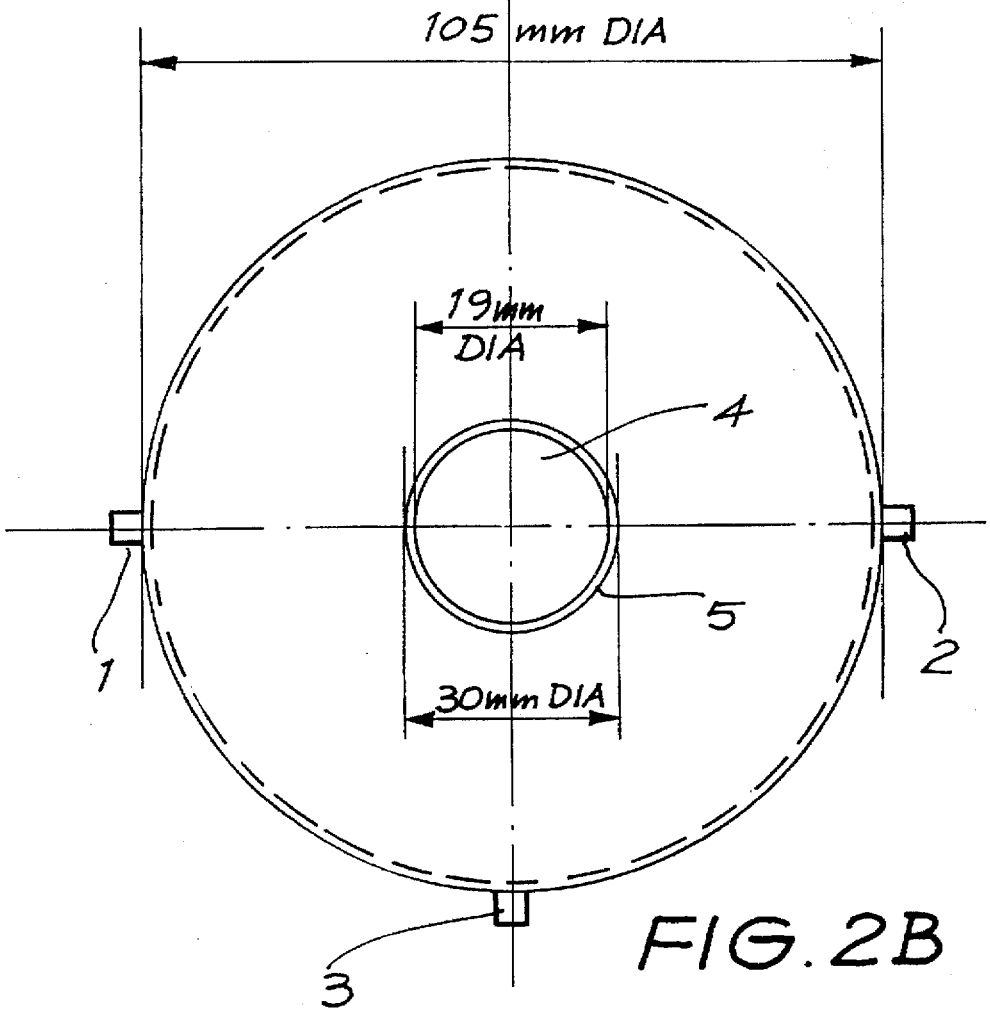
FIG. 2B provides a diagrammatic plan view of the test cells for testing oxygen permeability.

Wool felt-based closures of various construction were tested for oxygen permeability as follows:

Six test cells were constructed from brass as shown in FIG. 2. The top, bottom and cork tube were soldered together, and the joins sealed using Loctite 290 sealant. The gas flushing ports (1) and (2) were sealed using solid ⅛" brass rod. The gas sampling port (3) was sealed using a silicone rubber septum.

The closure sample (4) was loaded into the top tube (5) using a cork inserter. Both gas flushing port caps were removed and nitrogen passed through the cell for ten minutes. During flushing the exit port (2) was blocked for short periods to allow gas build up to occur and cause turbulence within the cell. The exit port (2) was sealed first, followed by the entry port (1). The gas composition was analysed initially and at 24 hour intervals, using syringe extraction and gas chromatography. From these results the oxygen permeation was calculated.

The results of the tests are provided at Table 3.

TABLE 3

Oxygen Ingress (ml/day)

Blank cell

| Day 1 | Day 2 | Day 3 | Day 6 | Day 7 | Day 8 | Day 9 |
|---|---|---|---|---|---|---|
| 0.00 | 0.00 | 0.00 | 0.07 | 0.07 | 0.09 | 0.14 |

28 mm diameter wad (low density)

| | Day 1 | Day 2 | Day 3 | Day 6 |
|---|---|---|---|---|
| Untreated | | | | |
| Single coated (40 H @ 2.5%) | 110 | | | |
| Single coated (P20 @ 2.5% | 220 | | | |
| Single coated (x300 @ 2.5% | 220 | | | |
| Single coated cork | 0.7 | 0.7 | 0.7 | 0.7 |
| Paraffin coated cork | 1.1 | 1.1 | 1.1 | 1.1 |

18 mm diameter wad

| | Day 1 | Day 2 | Day 3 | Day 6 | Day 8 | Day |
|---|---|---|---|---|---|---|
| Foamed PVC composite. | 0.22 | 0.11 | 0.22 | 0.11 | 0.10 | 0.10 |
| wax coating (particulated 0.35 | 3.70 | 4.20 | 5.20 | 3.50 | 3.40 | 3.20 |

TABLE 3-continued

Oxygen Ingress (ml/day)

| | | | | | | |
|---|---|---|---|---|---|---|
| g/cm³ wool felt) | | | | | | |
| PVC plasticiser low density, | 0.22 | 0.11 | 0.13 | 0.09 | 0.08 | 0.09 |
| wax coating | 2.00 | 2.20 | 2.90 | 2.10 | 2.10 | 2.10 |
| Silicon coated cork | 0.11 | 0.22 | 0.22 | 0.22 | 0.19 | 0.17 |
| Paraffin coated cork | 0.00 | 0.11 | 0.11 | 0.06 | 0.07 | 0.07 |
| Silicone coated cork | 0.7 | 0.7 | 0.7 | 0.7 | | |
| Paraffin coated cork | 1.1 | 1.1 | 1.1 | 1.1 | | |

18 mm diameter wad

| | Day 1 | Day 2 | Day 5 | Day 6 | Day 7 |
|---|---|---|---|---|---|
| PVC plasticiser, low density | 2.48 | 1.74 | 1.92 | 0.48 | 0.41 |
| no wax | 3.30 | 2.39 | 2.42 | 0.36 | 0.93 |
| PVC foam, low density | 0.37 | 0.26 | 0.48 | 0.22 | 0.22 |
| wax coating | 0.22 | 0.08 | 0.02 | 0.03 | 0.06 |
| PVC plasticiser, | | 0.11 | 0.05 | 0.03 | 0.00 |
| high density wad | | 0.08 | 0.05 | 0.03 | 0.00 |

18 mm diameter wad (0.35 g/cm³)

| | Day 1 | Day 2 | Day 5 | Day 6 |
|---|---|---|---|---|
| Double coated (360D @ | 0.15 | 0.06 | 0.15 | 0.15 |
| 50% solids) low density | 2.53 | 2.42 | 4.51 | 0.72 |
| Thermoformed, low density | 14.7 1 | 9.02 | 1.20 | 0.49 |

Low density = 0.35 g/cm³

EXAMPLE 46

Extraction strength tests on various closures

Tests were carried out to determine the force required to remove various closures from the bottle.

The procedure was as per ISO 9727:1991(E), with the exception that a commercially available corkscrew was used rather than machining the standard corkscrew. The storage conditions varied from one day to eight days with and without wine simulant (12% ,v/v ethanol in a saturated potassium bitartrate solution). The Results are shown at Tables 4 and 5.

TABLE 4

Pull out tests (24 hours exposure to wine simulant

| Sample | Force (N) | Comments |
|---|---|---|
| | 22 mm low density (0.35 g/cm³ nominal | |
| Untreated | no result | Wad wet, push through |
| | no result | Wad wet, push through |
| | no result | Wad wet, push through |
| Thermoformed with SURLYN | 107.8 | Wad was above neck of bottle |
| | 19.6 | Wad turned in bottle, thus corkscrew did not penetrate through the wad |
| | 19.6 | Wad was wet, above bottle neck and it turned in the bottle, plastic on wad torn. |
| Single wax coated @ 100° C. | 39.2 | Wad wet, wax splitting |
| | 9.8 | Wad wet, wax splitting |
| | no result | Push through |

TABLE 4-continued

| Pull out tests (24 hours exposure to wine simulant | | |
|---|---|---|
| Sample | Force (N) | Comments |
| Two piece wad | no result | Wad separated after being pushed through |
| | no result | |
| | no result | |
| Double coated (360 D @ 50% solids | 245 | Wad above bottle neck 360 D changed to white colour were in contact with alcohol |
| | 284.2 | Wad above bottle neck 360 D changed to white colour were in contact with alcohol |
| solids | 58.8 | Wad above bottle neck 360 D changed to white colour were in contact with alcohol |
| 19 mm low density (0.35 g/cm$^3$ nominal) | | |
| PVC plasticiser in 21 mm cylinder | no result | Push through |
| | no result | Push through |
| 19 mm high density (0.45 g/cm$^3$ nominal) | | |
| PVM foam in 21 mm cylinder | 44 | |
| | 157 | Bottom of wad damaged, slight absorption of blue dye on wad |
| PVC plastisol in 21 mm cylinder | 370 | Bottom of wad split, some blue dye absorbed |
| 18 mm low density (0.35 g/cm$^3$ nominal) | | |
| Foam PVC wax coated | 20 | Wax lifted from wad, no wax left, in bottle neck, wad turned in bottle |
| PVC plasticiser wax coated | 98 | Wax on wad lifting, wax left in bottle neck |
| | 58.8 | Wax on wad lifting, wax left in bottle neck |
| PVC plasticiser in 21 mm cylinder | 98.8 | Wad stained on the side with blue dye, |
| | 197.6 | bottom puckered |
| | | Bottom puckered |
| 18 mm high density (0.45 g/cm$^3$) | | |
| PVC plastisol | 171.5 | Wad picked up some wax, possibly form corking |
| | 107.18 | machine |
| | 58.8 | Push through. Wad had picked up wax possibly from corker |
| | | Wad turned in bottle, wax remained on wad however wax was lifting |
| Singel wax coated @ 160° C. | No result | Push through |
| | No result | |
| Double wax coated @ 160° C. | No result | Push through. Wad had dropped in bottle neck |
| | No result | Push through, very little wax remained on wad. |
| 17 mm high density (0.45 g/cm$^3$) | | |
| PPVC plasticiser wax coated | 96 | Wax remained on wad, no wax on bottle, wad 10 mm above bottle neck |
| | 39.2 | Wax remained on wad |
| Natural cork | | |
| Paraffin coated | 297.9 | |
| | 188.2 | |
| | 282.2 | |
| Silicon coated | 172.5 | |
| | 235.2 | |
| | 164.6 | |

TABLE 5

| Pullout tests (controls of corks and untreated wads with no simulant) | | |
|---|---|---|
| Sample | Force (N) | Comments |
| Pullout performed after 24 hours | | |
| 0.35 nominal density | 270 | |
| | 240 | |
| | 230 | |
| 0.45 nominal density | Zero | Pushed in. The harder wad requires greater effort to engage thread of corkscrew. |

TABLE 5-continued

| Pullout tests (controls of corks and untreated wads with no simulant) | | |
|---|---|---|
| Sample | Force (N) | Comments |
| Cork Parrafin coated | 150 | |
| | 150 | |
| | 160 | |
| Cork Silicon coated | 130 | |
| | 220 | |
| | 30 | |
| | 28 | |

TABLE 5-continued

| Pullout tests (controls of corks and untreated wads with no simulant) | | |
|---|---|---|
| Sample | Force (N) | Comments |
| Pullout performed after 7 days | | |
| Cork Paraffin coated | 290 | |
| | 270 | |
| | 280 | |
| | 170 | |
| | 210 | |
| | 230 | |
| Cork Silicone coated | 100 | |
| | 120 | |
| | 125 | |
| | 130 | |
| | 130 | |
| | 120 | |

EXAMPLE 47

Liquid Leakage Storage Tests

Liquid leakage with various wool felt-based closure constructions were assessed by weighing the sealed bottle containing the wine simulant at 24 hour intervals. The results are provided at Table 6.

TABLE 6

| STORAGE TEST | Water loss (g) | | | | | |
|---|---|---|---|---|---|---|
| | 1 days | 2 days | 3 days | 4 days | 5 days | 6 da |
| Low Density (0.35 g/cm$^3$) 22 mm wad | | | | | | |
| Untreated | 9.5 | 0.9 | 2.0 | 1.4 | 0.3 | 2.2 |
| | 7.9 | 0.6 | 1.9 | 1.5 | 3.3 | 2.0 |
| | 8.7 | 0.7 | 1.9 | 1.7 | 3.6 | 2.0 |
| Thermoformed with SURLYN | +0.1 | 0.0 | 0.0 | 0.0 | 0.0 | 0.0 |
| | 4.9 | 0.3 | 1.2 | 0.5 | 1.3 | 1.7 |
| | 3.6 | 0.7 | 1.3 | 1.5 | 3.8 | 2.2 |
| Single wax coated @ 110° C. | 3.5 | 0.0 | 2.2 | 0.4 | 1.1 | 1.5 |
| | 5.4 | 0.9 | 1.8 | 1.6 | 3.7 | 2.1 |
| | 5.1 | 0.7 | 1.7 | 1.8 | 4.2 | 2.4 |
| Two piece wad | 6.3 | 0.7 | 1.8 | 1.7 | 4.1 | 2.0 |
| | 6.2 | 0.6 | 1.8 | 1.4 | 3.1 | 1.9 |
| | 7.7 | 0.7 | 1.8 | 1.6 | 3.6 | 2.3 |
| Double coated (360 D @ 50% solids) | +0.3 | +0.1 | 0.0 | 0.1 | 0.0 | 0.0 |
| | +0.3 | 0.0 | +0.1 | 0.0 | 0.1 | 0.0 |
| | 4.4 | 0.3 | 0.5 | 0.8 | 2.4 | 0.2 |
| High density 18 mm wad coated with PVC plasticiser | | | | | | |
| No wax coating | 0.0 | 0.0 | +0.1 | | | |
| | 0.0 | 0.0 | 0.0 | | | |
| | 0.0 | 0.0 | 0.0 | | | |
| Single wax coated @ 160° C. | 0.0 | 0.0 | 0.0 | | | |
| | 0.0 | 0.0 | 0.0 | | | |
| Double wax coated @ 160° C. | 0.0 | 1.0 | 1.6 | | | |
| | 0.3 | 0.1 | 0.5 | | | |

Note: high density wads are 0.45 g/ml

EXAMPLE 48

Evaluation of Properties of Wool Felt-PVC Plastisol Closures Against ISO Standards for Cork

EXPERIMENTAL

Six of the Wool felt-PVC plastisol closures described in Example 1 (approximately 33×20 mm) were inserted into 750 ml bottles which had previously been filled with 10% aqueous ethanol solution, sufficient to allow an ullage distance of 15 mm from the level of the solution and the underside of the closure. The force required to remove the cork from the bottles (extractive force) was determined after a period of eight days, using a Mecmesin AFG1000 digital force gauge.

The method used was identical with that specified in ISO 9727, Section 7.6.1, International Organisation for Standardisation (ISO 9727: Cylindrical stoppers of natural cork—physical tests—reference methods, Geneva: ISO; 1991) except that bottles with Stein type bore were used in place of those with the CETIE type bore profile, as the latter were not available. The corking machine used was of a three jaw design rather than the four jaw design specified.

Absorption

Six of the wool felt-PVC plastisol closures were numbered and weighed, inserted into bottles filled with 10% ethanol solution and stored in a horizontal position for eight days. After this tame they were removed, placed on a Whatman No. 4 filter paper for one minute, and then reweighed (the same six closures were used in this test and in the extraction strength test described above).

The method followed is based on ISO 9272, Section 7.8. Stein bore rather than CETIE bore bottles were used, and a three jaw corking machine was used.

$$\text{Absorption} = \frac{m_f - mi}{m_f} \times 100\%$$

Wine Travel

The Varanda apparatus was used to test the resistance of the closures to wine travel. Closures were inserted into three of each of 18 mm and 19 mm internal diameter acrylic "bottle necks" using a corking machine, which were inverted, then filled with dye solution after two hours and attached to the apparatus and tested according to the instructions supplied. The closures were trimmed of excess plastic before insertion. For comparative purposes, natural wane corks (44×24 mm) were also tested. All closures were then examined for wine travel after 10 minutes exposure to pressures of 0.5 bar, 1.0 bar, 1.5 bar, 2.0 bar and 2.5 bar.

RESULTS

Extraction Force

Results of extraction force are summarised in Table 7. Extraction force should lie between 200N and 300N; the results for five of the six closures tested lie within this range, while the result for one closure was low. It must be noted that these standards relate to corks inserted into bottles with the CETIE type bore, while bottles with a Stein type bore were used in the tests. The slightly greater diameter of the CETIE bore may be expected to result in slightly lower values for extraction force.

Absorption

Results of the absorption tests are also summarised in Table 7. The CTCOR specifications for absorption following the test method described have also been obtained; the absorption for natural corks should be less than 3%, and for agglomerate corks, less than 40%. The results obtained were well below both these specifications.

Wine Travel

Virtually no travel of the dye solution was observed in any of the six closures tested, even at the maximum test pressure of 2.5 bar. Two of the closures were cut in half lengthwise after testing, and this revealed that the dye had not penetrated the coating. In comparison, considerable travel was observed in the natural wine corks at a pressure of 0.5 bar. It is acknowledged, however, that the behaviour of these corks may not be typical of all corks.

TABLE 7

Results of measurements of extraction force and absorption of wool felt - PVC plastisol closures

| Closure | Extraction Force (N) | Absorption (% w/w) |
|---|---|---|
| 1 | 244 | 0.16 |
| 2 | 281 | 0.15 |
| 3 | 166 | 1.02 |
| 4 | 218 | 0.12 |
| 5 | 299 | 0.16 |
| 6 | 259 | 0.16 |
| mean | 244.5 | 0.295 |

The results indicate that the wool felt-PVC plastisol closures performed well in terms of extraction force, absorption and wine travel. Some closures had slightly low extraction force, compared with available standards. This may be able to be improved upon by increasing the diameter of the closures.

CONCLUSIONS

PVC (foamed and non-foamed) coatings gave good oxygen permeation and liquid leakage results. The diameter of the closures together with the compressibility of the wad and the nature or composition of the additives can be selectively chosen to produce closures with a range of reproducible pull-out forces, thereby providing an advantage over variability encountered with cork closures. Of all the latexes tested, BASF 360D formed the suitable coherent film. When used as a double-dip coating, the BASF 360D latex gave reasonable results. The extraction results were close to those specified by the ISO standards for cork.

The Surlyn thermoformed skin coated closures gave higher than expected oxygen permeation and liquid leakage results. This was probably due to thinning of the plastic film during thermoforming, which in some cases resulted in fibres protruding through the film.

Smaller diameter wads and/or denser wads minimised buckling and puckering which was sometimes observed with harder coatings on the lower density wool-felt wads. Coating the wads with a solventless polymeric system, namely PVC's, also provided a solution to this problem. It is anticipated that resilient polyurethanes would achieve similar results.

With coated closures, steps should be taken to ensure that the fibres do not reach the surface of the coat as this may allow a gas and liquid leakage path to form. Two methods to overcome this problem is the coating of the mould with a gel coat prior to insertion of the coated wad into the mould, and coating of the fibres with a hard polymer latex (e.g. PVDC) and then machining the exposed fibres off the coating.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A closure for a container having an opening, comprising:

(i) at least one resilient mass of fibres selected from synthetic fibres, natural fibres and mixtures thereof, said at least one resilient mass of fibres having a density of 0.15 to 2.00 g/cm$^3$ and having one of an interlocked structure, an associated structure and a combination thereof; and (ii) one or more additives, wherein the additives function to coat, impregnate or coat and impregnate at least a portion of the resilient mass of fibers, wherein the at least resilient mass and one or more additives form the closure, the closure being essentially impermeable to liquids and gases and, further, being sized and having a density to enable the closure to be sealingly inserted into the opening of said container.

2. A closure according to claim 1 wherein the resilient mass of fibres is formed by a process selected from felting, needle-punching, weaving, knitting and combinations thereof.

3. A closure according to claim 2 wherein the resilient mass of fibres is formed through felting.

4. A closure according to claim 1 wherein the fibres are natural fibres selected from vegetable fibres and animal-derived fibres.

5. A closure according to claim 4 wherein the natural fibres are selected from the group consisting of cotton, flax, sisal, linen, cellulose, jute, wool, angora, alpaca and mixtures thereof.

6. A closure according to claim 5 wherein the natural fibres are sheep wool fibres.

7. A closure according to claim 1 wherein the synthetic fibres are selected from the group consisting of cellulose acetate, cellulose triacetate, acrylics, aramids, rayons, polyolefins, nylons, polyesters, polyurethanes, terylenes and teflon and mixtures thereof.

8. A closure according to claim 1 wherein the resilient mass of fibres consists of a mixture of synthetic fibres and sheep wool fibres.

9. A closure according to claim 1 wherein the resilient mass of fibres has a density of 0.18 to 0.95 g/cm$^3$.

10. A closure according to claim 9 wherein the resilient mass of fibres has a density of 0.4 to 0.8 g/cm$^3$.

11. A closure according to claim 1 wherein the additive(s) are selected from the group consisting of polyethylene dispersions, modified polyethylene dispersions and gels of polymers such as ethylene vinylacetate copolymer (EVA), solutions and dispersions of poly(vinylidene chloride) (PVC's) and its copolymer, polyurethanes, acrylic latexes, lacquers and dispersions, thermoformed films, paraffins, waxes and silicones.

12. A closure according to claim 1 comprising multiple coatings of said additive(s).

13. A closure according to claim 11 wherein the additive (s) are selected from the group consisting of PVC's and polyurethanes.

14. A closure according to claim 1 wherein the additive(s) is incorporated into the resilient mass of fibres such that the fibres of at least a portion of the resilient mass of fibres are impregnated by the additive(s).

15. A closure according to claim 14 wherein the additive (s) are selected from the group consisting of polyethylene dispersions, modified polyethylene dispersions and gels of polymers such as ethylene vinylacetate copolymer (EVA), solutions and dispersions of poly(vinylidene chloride) (PVC) and its copolymers, polyurethanes, acrylic latexes, lacquers and dispersions, paraffins, waxes and silicones.

16. A closure according to claim 15 wherein the additive (s) are selected from the group consisting of PVC's, polyurethanes and acrylic latexes.

17. A closure according to claim 1 wherein the additive(s) comprises 0.01 to 70% (by weight) of the closure.

18. A closure according to claim 17 wherein the additive (s) comprises 0.1 to 30% (by weight) of the closure.

19. A closure according to claim 14 wherein the additive (s) comprises 0.1 to 30% (by weight) of the resilient mass of fibres.

20. A closure according to claim 1 wherein the closure includes more than one mass of fibres.

21. A closure according to claim 20 wherein the masses of fibers are separated from each other by one or more liquid-impermeable membranes, gas-impermeable membranes or combinations thereof.

22. A closure according to claim 21 wherein the membrane(s) extend to a slightly larger diameter than the fibre masses in order to at least assist in forming the seal between the closure and the surface of the container's openings.

23. A closure according to claim 1 wherein the closure further comprises one or more O-rings comprised of rubber or other resilient polymer, which at least assist in forming a seal between the closure and the container's opening.

24. A closure according to claim 1 wherein the closure has a size and density to enable the closure to be sealingly inserted into an opening of a wine bottle.

25. A closure according to claim 24 wherein the closure is shaped in the form of a cork.

26. A closure according to claim 25 wherein the ends of the closure are concave or convex.

27. A closure according to claim 25 wherein the diameter of the closure is in the range 17 to 28 mm.

28. A closure according to claim 25 wherein the length of the closure is in the range 24 to 55 mm.

29. A closure according to claim 1 wherein the resilient mass of fibres has a solid, essentially uniform cross-section throughout.

* * * * *

UNITED STATES PATENT AND TRADEMARK OFFICE

CERTIFICATE OF CORRECTION

PATENT NO. : 5,665,462

DATED : March 20, 1995

INVENTOR(S) : George Galloway DEWAR

It is certified that error appears in the above-identified patent and that said Letters Patent is hereby corrected as shown below:

Col. 1, L26: "new" should read --now--.

Col. 1, L46: "relied" should read --felted--.

Col. 2, L35: "weight)" should read --(by weight)--.

Col. 3, L7: "for" should read --(or--.

Col. 3, L24: "require menus" should read --requirements--.

Col. 4, L16: "bending" should read --bonding--.

Col. 4, L44: "lose" should read --loss--.

Col. 4, L44: "closure clean wool" should read --closure. Clean wool--.

Col. 4, L58: "wane" should read --wine--.

Col. 5, L52: "wed" should read --wad--.

Col. 6, L2: "bottom when" should read --bottom. When--.

Col. 10, L61: "39-30" should read --29-30--.

Col. 11, L39: "single coated cork" should read --silicone coated cork--.

UNITED STATES PATENT AND TRADEMARK OFFICE

CERTIFICATE OF CORRECTION

PATENT NO. : 5,665,462

DATED : March 20, 1995

INVENTOR(S) : George Galloway DEWAR

It is certified that error appears in the above-identified patent and that said Letters Patent is hereby corrected as shown below:

Page 2

Col. 16, L61: the definitions of "$m_f$" and "$m_i$" have been omitted. Please insert:

--Where $m_f$ = final weight of closure, g $m_i$ = initial weight of closure, g--.Col. 17, L5: "wane" should read --wine--.

Col. 17, L67: "the suitable" should read --the most suitable--.

Col. 18, L40: In claim 1, "least resilient" should read --least one resilient--.

Signed and Sealed this

Eighteenth Day of January, 2000

Q. Todd Dickinson

Q. TODD DICKINSON

*Commissioner of Patents and Trademarks*

*Attest:*

*Attesting Officer*